US007562997B2

(12) United States Patent
Liu

(10) Patent No.: US 7,562,997 B2
(45) Date of Patent: Jul. 21, 2009

(54) FLASHLIGHT WITH A BATTERY DEVICE HAVING PLURAL JOINED-TOGETHER BATTERIES

(76) Inventor: Yun-Zhao Liu, No. 3, 2nd St., Hsinfeng Rd., Huangpu Township, Zhongshan City, Guangdong Province (CN)

( * ) Notice: Subject to any disclaimer, the term of this patent is extended or adjusted under 35 U.S.C. 154(b) by 66 days.

(21) Appl. No.: 11/822,315

(22) Filed: Jul. 5, 2007

(65) Prior Publication Data

US 2009/0009991 A1 Jan. 8, 2009

(51) Int. Cl.
*F21L 4/04* (2006.01)
*F21L 4/00* (2006.01)

(52) U.S. Cl. ..... 362/206; 362/183; 362/202; 362/204; 362/205; 362/196

(58) Field of Classification Search ..... 362/183, 362/184, 196, 202, 204–206, 208, 222
See application file for complete search history.

(56) References Cited

U.S. PATENT DOCUMENTS

2005/0122714 A1* 6/2005 Matthews et al. ..... 362/206
2005/0135091 A1* 6/2005 Sharrah et al. ..... 362/205

* cited by examiner

*Primary Examiner*—Sharon E Payne
*Assistant Examiner*—Sean P Gramling
(74) *Attorney, Agent, or Firm*—Rosenberg, Klein & Lee

(57) ABSTRACT

A flashlight includes a shell, a battery device held in the shell, a light emitting member installed on a front end of the shell, and a tail cap for the shell; the battery device includes a casing, and several single-part batteries held in the casing; the casing comprises two covering parts, which are joined together; the battery device further includes a socket on the casing; positive and negative poles of the battery device are exposed through front and rear ends of the casing respectively, and they are electrically connected with the sockets; a circuit board is secured in the tail cap, and electrically connected with the battery device; the circuit board has a built-in microcomputer controller to control power to the light emitting member; after a plug of a charger is inserted in the socket of the battery device, the batteries together will be charged through the charger.

12 Claims, 2 Drawing Sheets

FLASHLIGHT WITH A BATTERY DEVICE HAVING PLURAL JOINED-TOGETHER BATTERIES

BACKGROUND OF THE INVENTION

1. Field of the Invention

The present invention relates to a flashlight, more particularly one, which is used with a battery device comprising plural joined-together single-part batteries.

2. Brief Description of the Prior Art

Common flashlights include a battery set, a shell, a light emitting member, a tail cap, and a switch. The switch is installed on a middle portion of the shell. The tail cap has a spring secured therein. A positive pole of the battery set, the light emitting member, the switch, and the spring together comprises an electric circuit, and the switch is operable to close/open the electric circuit.

Several common chargeable single-part batteries can be positioned in the shell of the flashlight to serve as the power source; to charge such chargeable single-part batteries, first the batteries are taken out of the shell, and positioned on a charger one by one.

Or alternatively, several common chargeable single-part batteries can be held and fixed in a plastic box to comprise the battery set; to charge the batteries, first the plastic box with the batteries is taken out of the flashlight, and located on a charger. Therefore, the conventional chargeable batteries are inconvenient to use. Furthermore, chargers for such conventional chargeable batteries have relatively large dimensions because they have a hollow holding portion to hold the batteries. Consequently, it takes relatively much cost to make such chargers.

SUMMARY OF THE INVENTION

It is a main object of the present invention to provide an improvement on a flashlight to overcome the above problems.

A flashlight according to an embodiment of the present invention is used with a battery device, which comprises at least two joined-together single-part batteries, and a socket electrically connected with the batteries; after a plug of a charger is inserted in the socket, the batteries will be charged through the charger without the battery device being located on the charger.

The flashlight of the present invention includes a shell, a battery device held in the shell, a light emitting member installed on a front end of the shell, and a tail cap to cover a tail end of the shell. The battery device includes a casing, and several single-part batteries held in the casing. The casing comprises two covering parts. Positive and negative poles of the battery device are exposed through front and rear ends of the casing respectively. The battery device further includes a socket on the casing, which is electrically connected with the positive and the negative poles of the battery device.

Furthermore, first and second electricity-conducting plates are secured on a tail end of the battery device, and electrically connected with the positive and the negative poles of the battery device respectively. And, a circuit board is secured in the tail cap; the circuit board has a built-in microcomputer controller to control power to the light emitting member; the circuit board has a switch installed thereon, which sticks out through the tail cap. First and second springs are secured next to the circuit board in the tail cap so as to be in touch with the first and the second electricity-conducting plates at a first end respectively. The first and the second springs being each electrically connected with the microcomputer controller at a second end thereof.

The switch is used to switch the microcomputer controller on the circuit board to one of several different modes in order for the microcomputer controller to make the light emitting member shine in a particular manner with a certain brightness; the light emitting member can be turned off, keep on emitting light or flash on and off repeatedly in a certain frequency.

The light emitting member can be a bulb or a light emitting diode. The tail cap, the first and the second springs are coaxial. The right and the left covering parts of the casing of the battery device can be welded or glued together.

The battery device of the flashlight further comprises a protective circuit board, which is secured in the casing for making charging and discharging safe.

The batteries will be charged together through a charger after the battery device is taken out of the flashlight, and a plug of the charger is inserted in the socket of the battery device.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
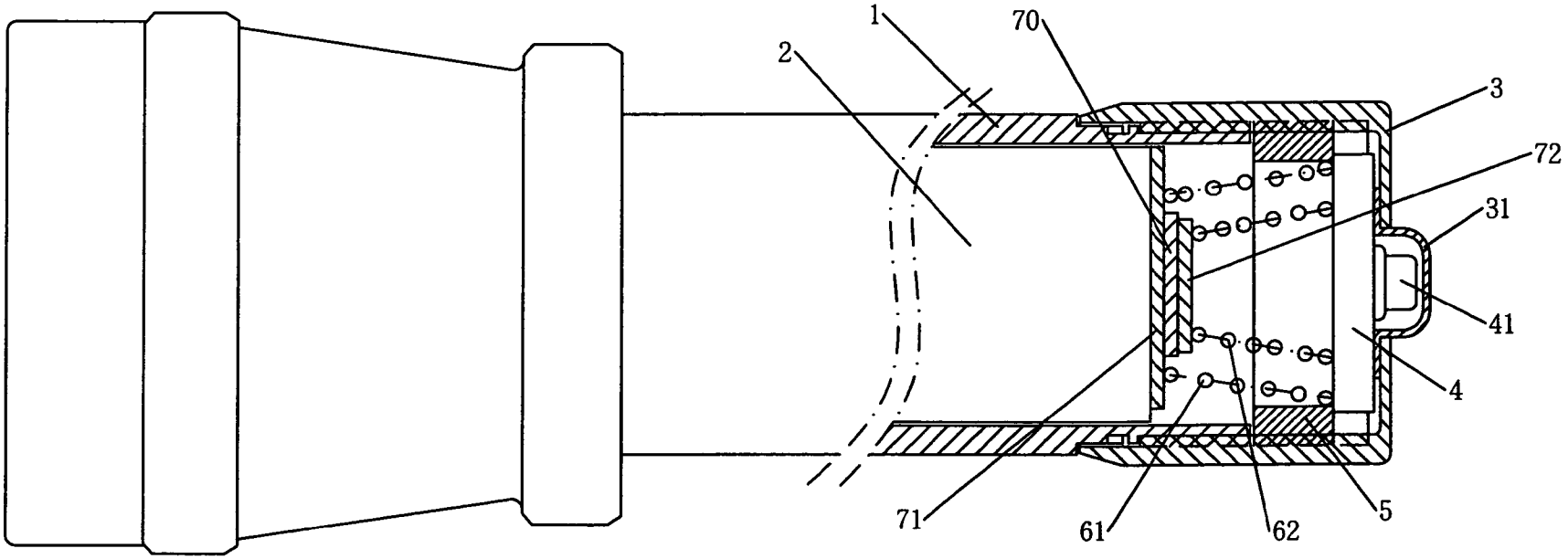
FIG. 1 is a simplified sectional view of a preferred embodiment of a flashlight of the present invention.

Referring to FIG. 1, a preferred embodiment of a flashlight of the present invention includes a tube-shaped shell 1, a battery device 2, a light emitting member (not shown), and a tail cap 3. The battery device 2 is held in the tube-shaped shell 1 while the light emitting member is installed on a front end of the tube-shaped shell 1.

The tube-shaped shell 1 has threads on an outer side of a tail end thereof, and the tail cap 3 has threads on an inner side thereof; thus, the tail cap 3 can be securely joined to the tail end of the tube-shaped shell 1 by means of the threads. The tail cap 3 has a rubber covering part 31 sticking our through a hole thereof.

The flashlight further includes a first electricity-conducting plate 71, a second electricity-conducting plate 72, and an isolating member 70 interposed between the first and the second electricity-conducting plates 71 and 72. The electricity-conducting plates 71 and 72 with the isolating member 70 are installed on a tail end of the battery device 2.

The flashlight further includes a circuit board 4, first and second springs 61 and 62, and a fixing piece 5, which is received in and securely joined to the tail cap 3 so as to fix the rubber covering part 31 in position; the fixing piece 5 has threads on an outer side thereof, which are engaged with the inner threads of the tail cap 3.

The circuit board 4 is secured on the fixing piece 5, and has a built-in microcomputer controller (not shown), and it has a switch 41 installed thereon. The first and the second springs 61 and 62 are arranged so as to be coaxial, and securely joined to an inner side of the fixing piece 5, and are each connected with the circuit board 4 at a first end thereof. When the fixing piece 5 is secured in the tail cap 3, the circuit board 4 will be pressed against a periphery of the rubber covering part 31 with the switch 41 facing the rubber covering part 31; thus, the rubber covering part 31 is sandwiched and secured between the circuit board 4 and an inner side of the tail cap 3 at a periphery thereof. And, the switch 41 should be operated by means of pressing the rubber covering part 31.

The first and the second springs 61 and 62 will be in touch with the first and the second electricity-conducting plates 71 and 72 respectively at a second end thereof when the tail end of the tube-shaped shell 1 is covered with the tail cap 3. Furthermore, the light emitting member is interposed between and electrically connected with the first electricity-conducting plate 71 and a positive pole of the battery device 2. And, a negative pole of the battery device 2 is electrically connected with the second electricity-conducting plate 72.

The switch 41 is used to switch the microcomputer controller on the circuit board 4 to one of several different modes in order for the microcomputer controller to make the light emitting member shine in a particular manner with a certain brightness; the light emitting member can be turned off, keep on emitting light or flash on and off repeatedly in a certain frequency. The user is allowed to keep on pressing the switch 41 for a certain length of time to change the microcomputer controller from one mode to another. Or alternatively, the user can press the switch 41 a certain number of times to change the mode of the microcomputer controller.

The light emitting member of the flashlight will emit the most powerful light, powerful light, moderate light, and weak light in sequence repeatedly if the user keeps on pressing the switch 41. And, the light emitting member will stop changing brightness, and start to keep on emitting the same brightness of light instead as soon as the user stops pressing the switch 41. Subsequently, if the user presses the switch 41 one time, the light emitting member will start flashing on and off repeatedly. Afterwards, if the user presses the switch 41, and keeps it in the pressed position, the flashing frequency of the light emitting member will change from a greater value to a smaller value, and from the low value to the high value repeatedly; the higher flashing frequency is approximately 8 Hz, in which frequency the light of the light emitting member can disturb people's nervous system, capable of protecting the user when the user is under attack. The lower flashing frequency is approximately 1 to 2 Hz, allowing the light of the light emitting member to serve as an SOS signal.

Figure 2:
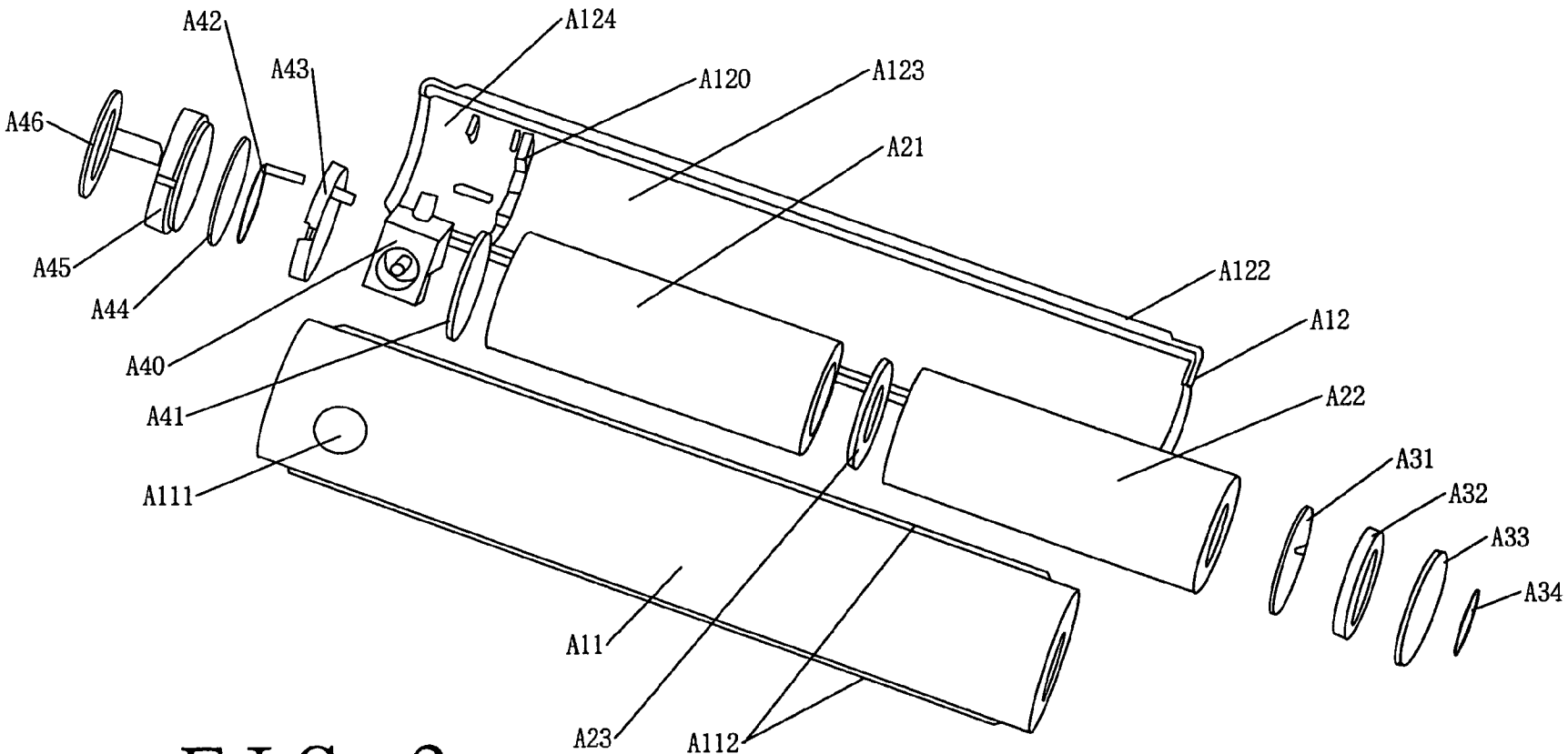
FIG. 2 is an exploded perspective view of a battery device of the flashlight of the present invention.

Shown in FIG. 2 is the battery device 2 of the flashlight of the present invention. The battery device 2 includes a casing, and a battery set. The battery set include a first single-part battery A22, and a second single-part battery A21. And, the casing comprises a right covering part A11, and a left covering part A12.

The left covering part A12 has a separating rib portion A120 in an internal space thereof, which divides the left covering part A12 into an upper holding portion A123 for containing the batteries A22 and A21, and a lower holding portion A124 to contain a socket. The left covering part A12 has guiding rib portions A122 on two sides of an opening thereof.

The right covering part A11 has a separating rib portion (not shown) in an internal space thereof like the left covering part A12; the separating rib portion divides the right covering part A11 into an upper holding portion for containing the batteries A22 and A21, and a lower holding portion. The right covering part A11 has guiding rib portions A112 on two sides of an opening thereof to be joined to corresponding said guiding rib portions A122 of the left covering part A12.

The right and the left covering parts A11 and A12 are joined together with the guiding rib portions A112 of the right covering part A11 being each securely joined to a corresponding said guiding rib portion A122 of the left covering part A12; the guiding rib portions A112 and A122 can be glued together or welded together by means of an ultrasonic welding machine. Therefore, the casing has a first holding room, which is defined by the upper holding portion of the right covering part A11 and the upper holding portion A123 of the left covering part A12, and a second holding room, which is defined by the lower holding portion of the right covering part A11 and the lower holding portion A124 of the left covering part A12.

The first and the second batteries A22 and A21 are connected in series to comprise the battery set. And, the battery set are held in the first holding room of the casing, which is defined by the upper holding portion of the right covering part A11 and the upper holding portion A123 of the left covering parts A12.

The battery device 2 further includes:

a socket A40 held in the second holding room of the casing, which is defined by the lower holding portion of the right covering part A11 and the lower holding portion A124 of the left covering parts A12; furthermore, the right covering part A11 has a lateral hole A111, which faces an opening of the socket A40;

a ringed pad A41, a pad A31, and a ringed sponge pad A32 held in the first holding room of the casing;

a protective circuit board A33 held in the first holding room of the casing; the protective circuit board A33 is electrically connected with positive and negative poles of the battery set as well as the socket A40 for making charging/discharging safe; the socket A40, the battery set, and the protective circuit board A33 are connected together with cords, which are passed through a gap between the separating rib of the right covering part A11 and the separating rib A120 of the left covering parts A12, and which are preferably formed with a flat plate-shape to save space;

a positive electrode plate A34, which is held in the first holding room of the casing and exposed through a hole formed on a right (first) end of the casing;

a ringed pad 23 interposed between the first and the second batteries A22 and A21;

an electrode holder A43 held in the second holding room of the casing;

a positive electrode A42 secured in the electrode holder A43;

a negative electrode holder A45 positioned inside the second holding room of the casing;

a negative electrode A46, which is secured in the negative electrode holder A45 and exposed through a hole formed on a left (second) end of the casing; and an adhesive member 44, the adhesive member 44 is sandwiched between the electrode holder A43 and the negative electrode holder A45 so as to couple the electrode holder A43 and the negative electrode holder A45 together.

A lateral hole can be formed on the left covering part A12 to fact the opening of the socket A 40 instead of the lateral hole A111 of the right covering part A111.

In addition, the tube-shaped shell 1 of the flashlight has guiding grooves (not shown) on an inner side thereof. And, the battery device 2 is held in the tube-shaped shell 1 of the flashlight with the guiding rib portions of the right and left covering parts of the casing being received in the guiding grooves on the inner side of the tube-shaped shell 1; thus, after the battery device 2 is installed in position, it can't change its orientation relative to the tube-shaped shell 1.

What is claimed is:

1. A flashlight with a battery device having plural joined-together batteries, comprising a shell, a battery device held in the shell, the battery device including a casing comprising a right covering part and a left covering part that are welded together; the battery device including at least two single-part batteries held in the casing; a positive and a negative poles of the battery device being exposed through the casing; the battery device including a socket on the casing, which is electrically connected with the positive and the negative poles of the battery device, the casing of the battery device having a plurality of axial guiding rib portions on an outer side thereof, and the shell has a plurality of guiding grooves on an inner side to receive the guiding rib portions of the casing;

a first and a second electricity-conducting plates secured on a tail end of the battery device, the first and the second being electrically connected with positive and negative poles of the battery device respectively;

a light emitting member, a tail cap to cover a tail end of the shell;

a circuit board secured in the tail cap, the circuit board having a built-in microcomputer controller to control a power to the light emitting member; the circuit board having a switch installed thereon, which sticks out through the tail cap; and a first and a second springs, which are secured next to the circuit board in the tail cap so as to be in touch with the first and the second electricity-conducting plates at a first end respectively; the first and the second springs being each electrically connected with the microcomputer controller at a second end thereof.

2. The flashlight with a battery device having plural joined-together batteries as claimed in claim 1, wherein the switch is covered with a rubber covering part, which is sandwiched between the circuit board and an inner side of the tail cap at a periphery thereof.

3. The flashlight with a battery device having plural joined-together batteries as claimed in claim 1, wherein the circuit board is secured on a fixing piece, and the fixing piece is joined to the tail cap by means of threads.

4. The flashlight with a battery device having plural joined-together batteries as claimed in claim 1, wherein the light emitting member is electrically connected with the first electricity-conducting plate as well as one of the poles of the battery device.

5. The flashlight with a battery device having plural joined-together batteries as claimed in claim 1, wherein the light emitting member is chosen from a group including bulbs and light emitting diodes.

6. The flashlight with a battery device having plural joined-together batteries as claimed in claim 1, wherein the first and the second springs and the tail cap are coaxial.

7. The flashlight with a battery device having plural joined-together batteries as claimed in claim 1, wherein the guiding rib portions are formed on two sides of an opening of each of the left and the right covering parts.

8. The flashlight with a battery device having plural joined-together batteries as claimed in claim 1 further comprising a protective circuit board, which is secured in the casing for making charging and discharging safe; the protective circuit board being electrically connected with the socket, the positive pole, and the negative pole of the battery device.

9. The flashlight with a battery device having plural joined-together batteries as claimed in claim 1, wherein each of the left and the right covering parts has a separating rib portion in an internal space thereof, and the separating rib portions divide the casing into a first holding portion, in which said at least two single-part batteries are held, and a second holding portion, in which the socket is secured; the right covering part having a lateral hole thereon, which faces an opening of the socket.

10. A flashlight with a battery device having plural joined-together batteries, comprising:

a shell;

a battery device held in the shell, the battery device including a casing having a right covering part and a left covering part that are glued together; the battery device including at least two single-part batteries held in the casing; a positive and a negative poles of the battery device being exposed through the casing; the battery device including a socket on the casing, which is electrically connected with the positive and the negative poles of the battery device, the casing of the battery device having a plurality of axial guiding rib portions on an outer side thereof, and the shell having a plurality of guiding grooves on an inner side to receive the guiding rib portions of the casing;

a first and a second electricity-conducting plates secured on a tail end of the battery device, the first and the second being electrically connected with positive and negative poles of the battery device respectively;

a light emitting member;

a tail cap to cover a tail end of the shell;

a circuit board secured in the tail cap, the circuit board having a built-in microcomputer controller to control a power to the light emitting member; the circuit board having a switch installed thereon, which sticks out through the tail cap; and a first and a second springs, which are secured next to the circuit board in the tail cap so as to be in touch with the first and the second electricity-conducting plates at a first end respectively; the first and the second springs being each electrically connected with the microcomputer controller at a second end thereof.

11. The flashlight with a battery device having plural joined-together batteries as claimed in claim 10, wherein the guiding rib portions are formed on two sides of an opening of each of the left and the right covering parts.

12. A flashlight with a battery device having plural joined-together batteries, comprising:

a shell;

a battery device held in the shell, the battery device including a casing having a right covering part and a left covering part that are joined together; the battery device including at least two single-part batteries held in the casing; a positive and a negative poles of the battery device being exposed through the casing; the battery device including a socket on the casing, which is electrically connected with the positive and the negative poles of the battery device, each of the left and the right covering parts has a separating rib portion in an internal space thereof, and the separating rib portions divide the casing into a first holding portion, in which said at least two single-part batteries are held, and a second holding portion, in which the socket is secured; the left covering part having a lateral hole thereon, which faces an opening of the socket;

a first and a second electricity-conducting plates secured on a tail end of the battery device, the first and the second being electrically connected with positive and negative poles of the battery device respectively;

a light emitting member;

a tail cap to cover a tail end of the shell;

a circuit board secured in the tail cap, the circuit board having a built-in microcomputer controller to control a power to the light emitting member; the circuit board having a switch installed thereon, which sticks out through the tail cap; and a first and a second springs, which are secured next to the circuit board in the tail cap so as to be in touch with the first and the second electricity-conducting plates at a first end respectively; the first and the second springs being each electrically connected with the microcomputer controller at a second end thereof.

* * * * *